US007481392B2

(12) United States Patent
Offerhaus

(10) Patent No.: US 7,481,392 B2
(45) **Date of Patent: *Jan. 27, 2009**

(54) DISPOSABLE/REUSABLE CORE ADAPTERS

(75) Inventor: Douglas Henry Offerhaus, Campbell River (CA)

(73) Assignee: Catalyst Paper Corporation, Richmond, BC (CA)

( * ) Notice: Subject to any disclaimer, the term of this patent is extended or adjusted under 35 U.S.C. 154(b) by 257 days.

This patent is subject to a terminal disclaimer.

(21) Appl. No.: 11/418,056

(22) Filed: May 5, 2006

(65) Prior Publication Data

US 2006/0196987 A1 Sep. 7, 2006

(51) Int. Cl.
*B65H 75/24* (2006.01)

(52) U.S. Cl. ..... 242/573.1; 242/576; 242/599.4

(58) Field of Classification Search ..... 242/599.4, 242/597.6, 612, 613, 576, 573.7, 573.2, 573, 242/573.1, 577, 571; 269/48.2, 48.1; 279/2.01; 403/109.2, 109.3, 109.6
See application file for complete search history.

(56) References Cited

U.S. PATENT DOCUMENTS

| | | | |
|---|---|---|---|
| 2,616,633 | A | 11/1952 | Reynolds |
| 3,322,361 | A | 5/1967 | Young |
| 3,502,279 | A | 3/1970 | Bundschuh et al. |
| 3,811,635 | A | 5/1974 | Goddard |
| 4,381,088 | A | 4/1983 | Bryant |
| 4,516,786 | A | 5/1985 | Lund |
| 4,711,406 | A | 12/1987 | Barstow |
| 5,451,010 | A | 9/1995 | Heuser |
| 5,577,686 | A | 11/1996 | Moody |
| 5,651,511 | A | 7/1997 | Crowley et al. |
| 5,769,352 | A | 6/1998 | Biagiotti |
| 6,276,528 | B1 * | 8/2001 | Nowotny et al. ..... 206/397 |
| 6,503,008 | B2 | 1/2003 | Zevin et al. |

(Continued)

FOREIGN PATENT DOCUMENTS

| | | |
|---|---|---|
| CA | 2121276 | 10/1994 |

(Continued)

OTHER PUBLICATIONS 3 photographs of core adapters used for an unknown period of time at Quebecor World Dickson gravure and offset facility, Dickson, TN.

(Continued)

*Primary Examiner*—Peter M Cuomo
*Assistant Examiner*—William E Dondero
(74) *Attorney, Agent, or Firm*—Oyen Wiggs Green & Mutala LLP

(57) ABSTRACT

A core adapter formed as a hollow cylindrical sleeve. A plurality of radial apertures are formed in the sleeve. Each radial aperture is perpendicular to the sleeve's axis. Studs are provided in each radial aperture, initially recessed beneath the sleeve's outer surface. The sleeve's outside diameter is sized for insertion into a 6-inch inside diameter core. The sleeve's inside diameter is the same size as a 3-inch inside diameter core. The adapter is inserted into a 6-inch core until it is flush with the end of the core. Wedge-tipped bars are driven beneath each of the adapter's longitudinally aligned rows of studs, against the bottom of each stud, thereby driving the studs perpendicularly away from the sleeve's axis into the core.

12 Claims, 15 Drawing Sheets

U.S. PATENT DOCUMENTS

| | | | | |
|---|---|---|---|---|
| 7,007,886 | B2 | 3/2006 | Oesterwind et al. | |
| 7,210,648 | B2 * | 5/2007 | Offerhaus | 242/573.1 |

FOREIGN PATENT DOCUMENTS

| | | | |
|---|---|---|---|
| CA | 2121277 | | 10/1994 |
| CA | 2299107 | | 8/2000 |
| DE | 19607916 | A1 | 9/1996 |
| EP | 0121996 | B1 | 10/1984 |
| EP | 0704400 | A2 | 4/1996 |
| GB | 1110186 | A | 4/1968 |
| WO | 03055778 | A1 | 7/2003 |
| WO | 2006/034566 | | 4/2006 |

OTHER PUBLICATIONS

Printouts of nine color digital photographs of paper rolls, roll cores and core adapters used since 1991 by Sonoco Products Company, Hartsville, SC.

English translation of DE 19607916A1 referenced above.

"Paper Core Adapter", web page of SOS Service, Inc., Angola, IN, bearing 2004 copyright notice and accessible via Internet URL http://sosservice.net/paper__core__adapters.htm.

* cited by examiner

DISPOSABLE/REUSABLE CORE ADAPTERS

TECHNICAL FIELD

This invention provides both disposable and reusable core adapters, either of which facilitate mounting a roll wound on a larger inside diameter core in a reel stand having core chucks designed for use with a roll wound on a core having a smaller inside diameter. For example, a paper roll wound on a nominal 6-inch (15.24 cm) inside diameter core can be mounted in a reel stand having core chucks designed for use with a paper roll wound on a nominal 3-inch (7.62 cm) diameter core.

BACKGROUND

Web material such as paper, fabric, plastic film, metal foil, etc., is commonly wound onto a core. For example, paper rolls, such as newsprint or soft nip calendered rolls, are produced by winding a paper web onto a fiber core. Newsprint roll core diameters can vary, but two are prevalent, namely (nominal) 3-inch and (nominal) 6-inch inside diameter cores. Press room reel stands are equipped with core chucks sized to fit either 3-inch or 6-inch diameter cores, but not always both. Consequently, paper mills commonly supply newsprint wound on cores sized to fit each customer's unique combination of reel stands. For example, a customer having some reel stands equipped only with 3-inch core chucks and some reel stands equipped only with 6-inch core chucks will order some rolls wound on 3-inch cores and some rolls wound on 6-inch cores. This complicates management of press room roll inventories and restricts flexible allocation of rolls to reel stands, since rolls wound on 6-inch cores cannot be mounted on reel stands equipped only with 3-inch core chucks, and rolls wound on 3-inch cores cannot be mounted on reel stands equipped only with 6-inch core chucks.

Management of paper mill roll inventories is also complex. For example, a paper mill may need to delay production, until receipt of an appropriate combination of customer orders for rolls wound on 3-inch and 6-inch cores, to match the width of the paper machine winder for efficient production of the ordered rolls. This is because most winders cannot simultaneously wind sets of rolls on different diameter cores.

Prior art 6-to-3 inch core adapters have been used in an attempt to circumvent the foregoing problems. If such adapters are fitted into each of the opposed ends of a 6-inch diameter core, a paper roll wound on that core can be mounted on a reel stand equipped only with 3-inch core chucks. This allows a paper mill to efficiently wind all rolls onto 6-inch diameter cores—customers having reel stands equipped only with 3-inch core chucks can use such adapters to mount the rolls on those reel stands. This significantly improves press room efficiency—any warehoused roll of paper can be mounted on any reel stand at any time. Moreover, larger diameter cores are preferable because they are stiffer and less susceptible to vibration as the roll unwinds, which allows higher sustained operating speeds and improved runnability in the press room. Paper mills also benefit because excess production rolls wound on 6-inch diameter cores can be sold to customers who only have reel stands equipped with 3-inch core chucks, thus helping reduce the volume of dead stock in paper mill warehouses and avoiding expensive rewinding of paper rolls from cores of one diameter onto different diameter cores.

A typical prior art adapter is formed as a cylindrical steel sleeve, with an inside diameter suitable for engaging 3-inch core chucks. A plurality of ribs extend radially from the sleeve. The ribs are sized to tightly engage the inside diameter of a 6-inch diameter paper roll core, when the adapter's ribbed end is driven into the core. Such adapters usually have a protruding end flange which extends parallel to the side of the paper roll when the adapter is driven into the core. The flange necessitates reduction of the roll's width, which is undesirable because reduced-width rolls do not fully utilize the reel stand's width capacity. The protruding flange also precludes safe stacking, on end, of rolls in which such adapters have been installed. Such prior art adapters are also heavy, unwieldily, and may not effectively engage the core chuck's fingers, potentially allowing the roll to slip on the reel stand. Furthermore, installation of such prior art core adapters in a typical press room can be laborious and time consuming.

This invention addresses the shortcomings of such prior art adapters.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense. Although the invention is described and illustrated in relation to newsprint type paper rolls, persons skilled in the art will understand that the invention is readily usable with other core-wound web materials such as fabric, plastic film, metal foil, etc.

Disposable Core Adapter

Figure 1:
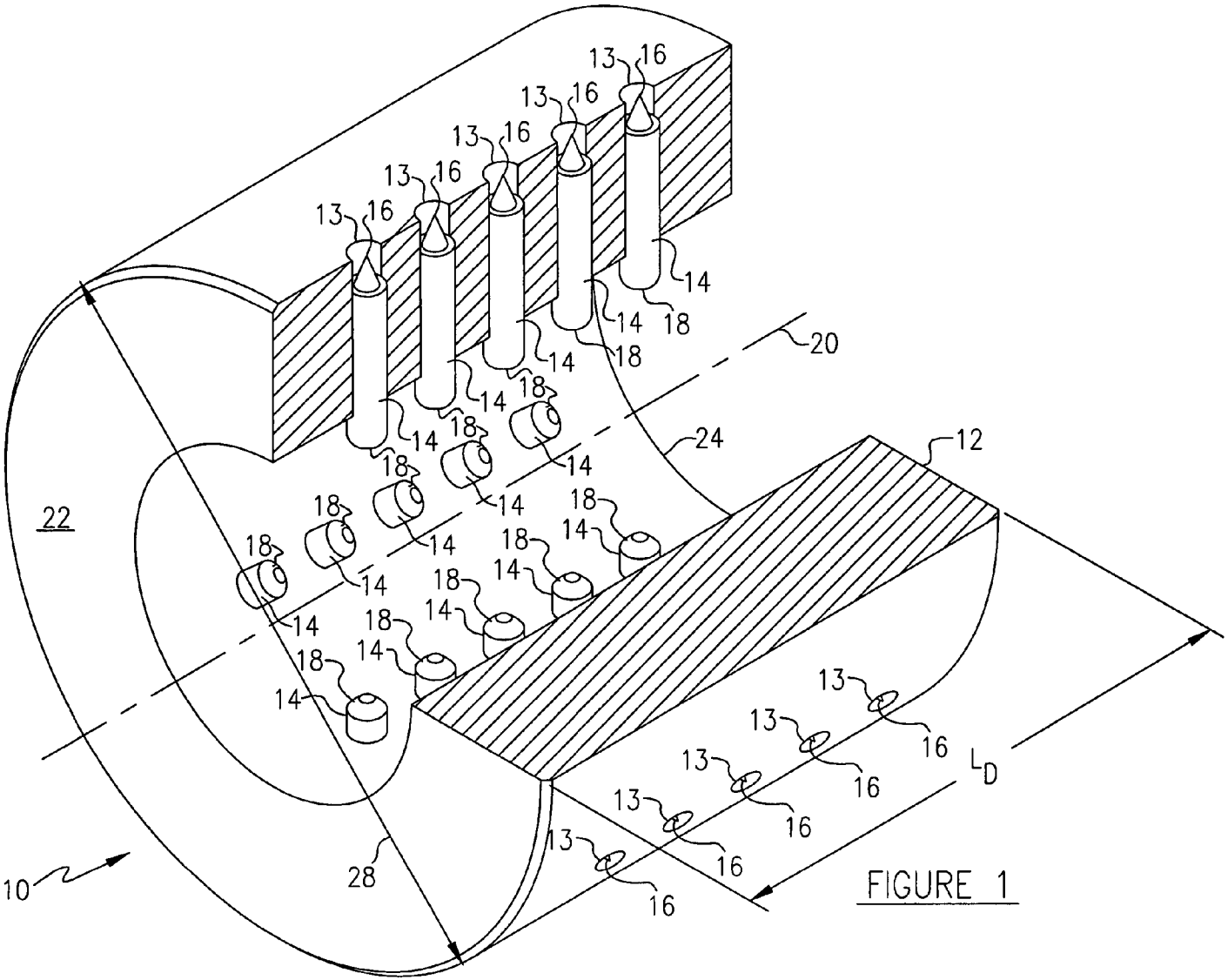
FIG. 1 is a partially sectioned isometric view of a disposable core adapter in accordance with the invention, showing the adapter's studs retracted.
Figure 2:
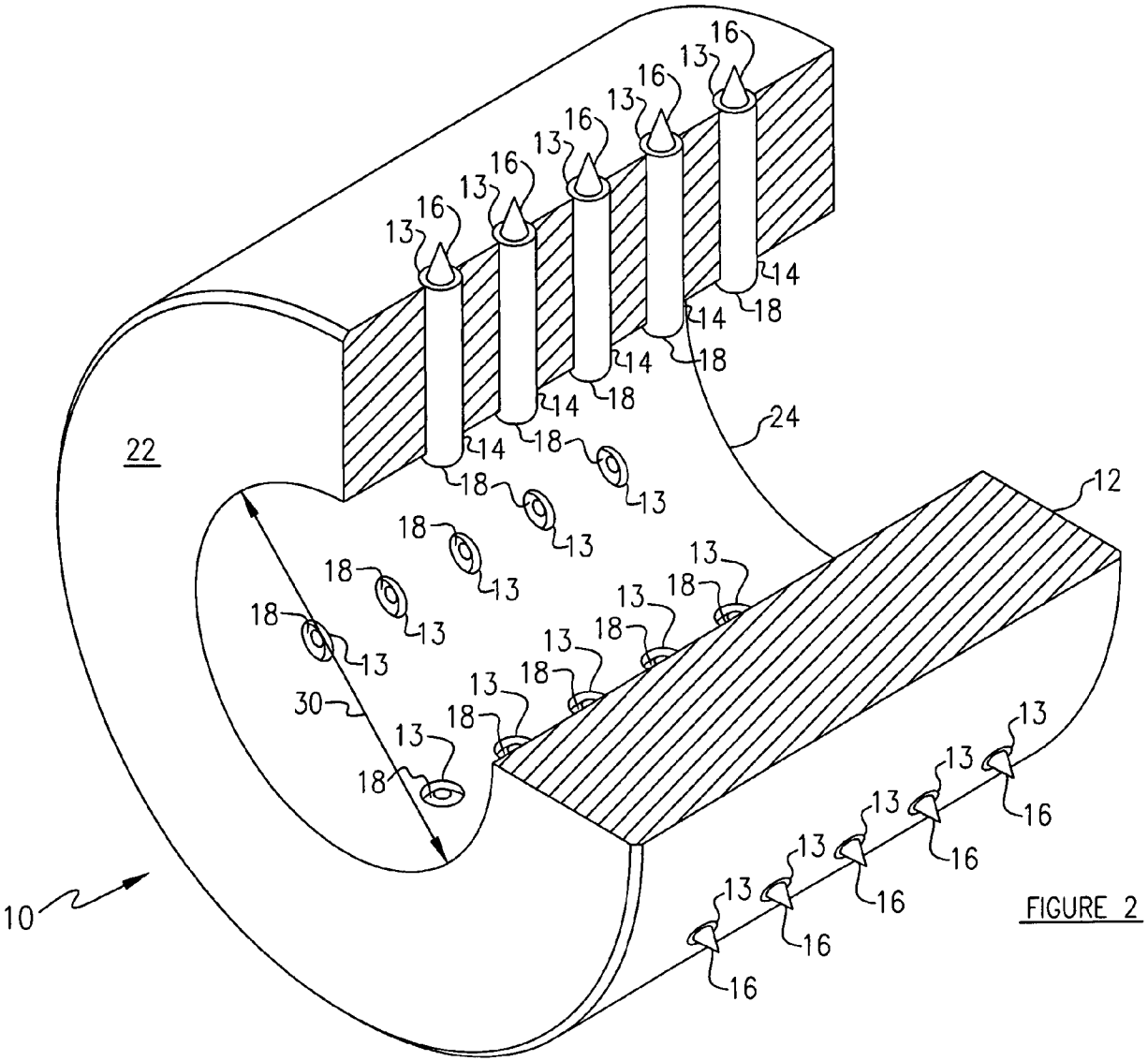
FIG. 2 shows the FIG. 1 disposable adapter with its studs extended.

FIGS. 1 and 2 depict a disposable core adapter 10 formed as a flangeless, ribless hollow cylindrical sleeve 12. Adapter 10 can be made from the same inexpensive fiber material used to make conventional paper roll cores, or made from other suitable material such as particle board, recycled plastic, rubber, etc. Such disposable adapters 10 are suitable for use in paper mills, where they can be quickly and economically installed to suit customer core size requirements, before the paper rolls are shipped to the customer. Such disposable adapters 10 are also suitable for use in a press room.

A plurality of (e.g. thirty) steel studs 14 are friction-fit embedded in apertures 13 formed radially in sleeve 12. Each stud 14 has a circular cross-section, a tapered (e.g. conical) spiked tip 16, and a rounded bottom 18. Tips 16 are initially recessed beneath sleeve 12's outer cylindrical surface so that bottoms 18 project into sleeve 12's hollow core, as shown in FIG. 1. Advantageously, each stud 14 has an overall length of about 1.77 inches (about 4.5 cm) and an external diameter of about 0.312 inches (about 0.794 cm). Each stud 14's conical tip is about 0.3 inches (about 0.762 cm) long.

Studs 14 are arranged in a plurality of (e.g. six) parallel rows spaced evenly and circumferentially around sleeve 12. Within each row, each stud is coplanar with one stud in each one of the other rows. A plurality of (e.g. five) studs are provided in each row, spaced evenly along the row. Each stud's longitudinal axis extends substantially perpendicular to sleeve 12's longitudinal axis 20. The outermost studs in each row are set back a suitable distance (e.g. about 1-inch or 2.54 cm) from sleeve 12's ends 22, 24 to prevent distortion of the roll's core during use of adapter 10 as explained below.

Disposable adapter sleeve 12's outside diameter 28 (FIG. 1) is sized for light friction-fit insertion into a standard 6-inch inside diameter paper roll core. Sleeve 12's inside diameter 30 (FIG. 2) is sized to the same tolerances as a standard 3-inch inside diameter paper roll core. Diameters 28, 30 define notional cylinders which are coaxial about axis 20. Disposable adapter 10 can have any reasonable length "$L_D$" (FIG. 1—e.g. about 5 inches, or 12.7 cm) to accommodate different core chuck designs.

Reusable Core Adapter

FIGS. 3, 4, 5A and 5B depict a reusable core adapter 110 formed as a flangeless, ribless hollow cylindrical sleeve 112 from a resilient material such as Delrin™ synthetic resinous plastic, available from E.I. du Pont De Nemours and Company, Wilmington, Del. Such reusable adapters are suitable for use in press rooms, where they can be efficiently and economically reused as explained below.

Figure 3:
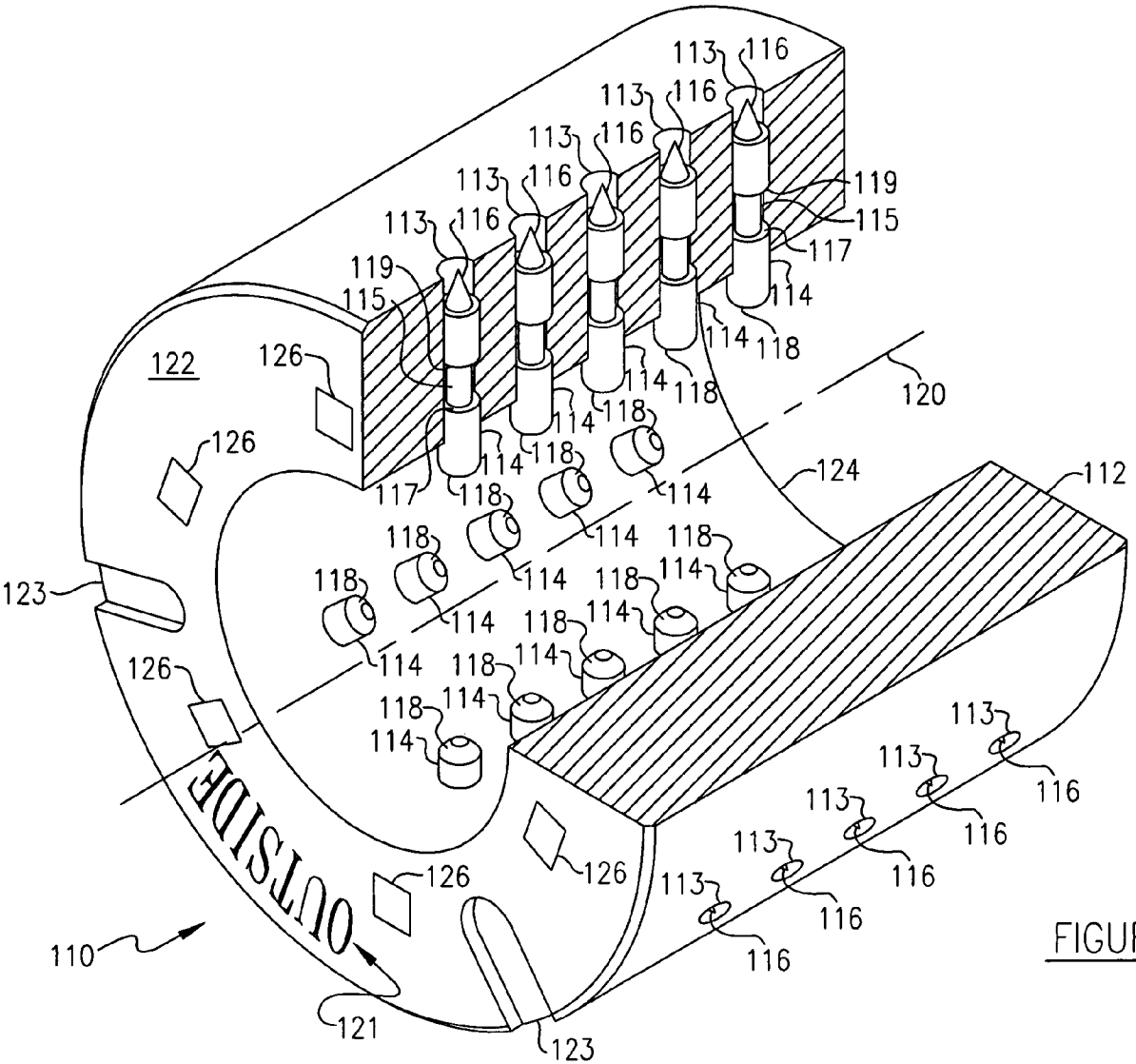
FIG. 3 is a partially sectioned isometric view of a reusable core adapter in accordance with the invention, showing the adapter's studs retracted.

A plurality of (e.g. thirty) steel studs 114 are friction-fit embedded in apertures 113 (FIGS. 3, 4, 5A and 5B) formed radially in sleeve 112. Each stud 114 has a circular cross-section, a tapered (e.g. conical) spiked tip 116, a rounded bottom 118, and a central circumferential groove 115 extending between lower and upper annular rims 117, 119. Tips 116 are initially recessed beneath sleeve 112's outer cylindrical surface so that bottoms 118 project into sleeve 112's hollow core, as shown in FIG. 3. Advantageously, each stud 114 has an overall length of about 1.77 inches (about 4.5 cm) and an external diameter of about 0.312 inches (about 0.794 cm). Each stud 114's conical tip is about 0.3 inches (about 0.762 cm) long. Groove 115 is about 0.4 inches (about 1.016 cm) long and about 0.188 inches (about 0.478 cm) in diameter.

Studs 114 are arranged in a plurality of (e.g. six) parallel rows spaced evenly and circumferentially around sleeve 112. Within each row, each stud is coplanar with one stud in each one of the other rows. A plurality of (e.g. five) studs are provided in each row, spaced evenly along the row. Each stud's longitudinal axis extends substantially perpendicular to sleeve 112's longitudinal axis 120. The outermost studs in each row are set back a suitable distance (e.g. about 1-inch) from sleeve 112's outward end 122 to prevent distortion of the roll's core during use of adapter 110 as explained below. Advantageously, studs 114 are heat treated to extend their durability and longevity. Outward end 122 is clearly labelled "OUTSIDE," as indicated at 121, during manufacture of adapter 110, for example by engraving the label wording into end 122. Such labelling facilitates correct mounting of adapter 110 on core adapter insertion tool 140 as explained below. Pry bar slots 123 are optionally formed in outward end 122 to facilitate removal of adapter 110 from reusable core adapter removal tool 240 (described below), if adapter 110 becomes jammed on tool 240.

Figure 4:
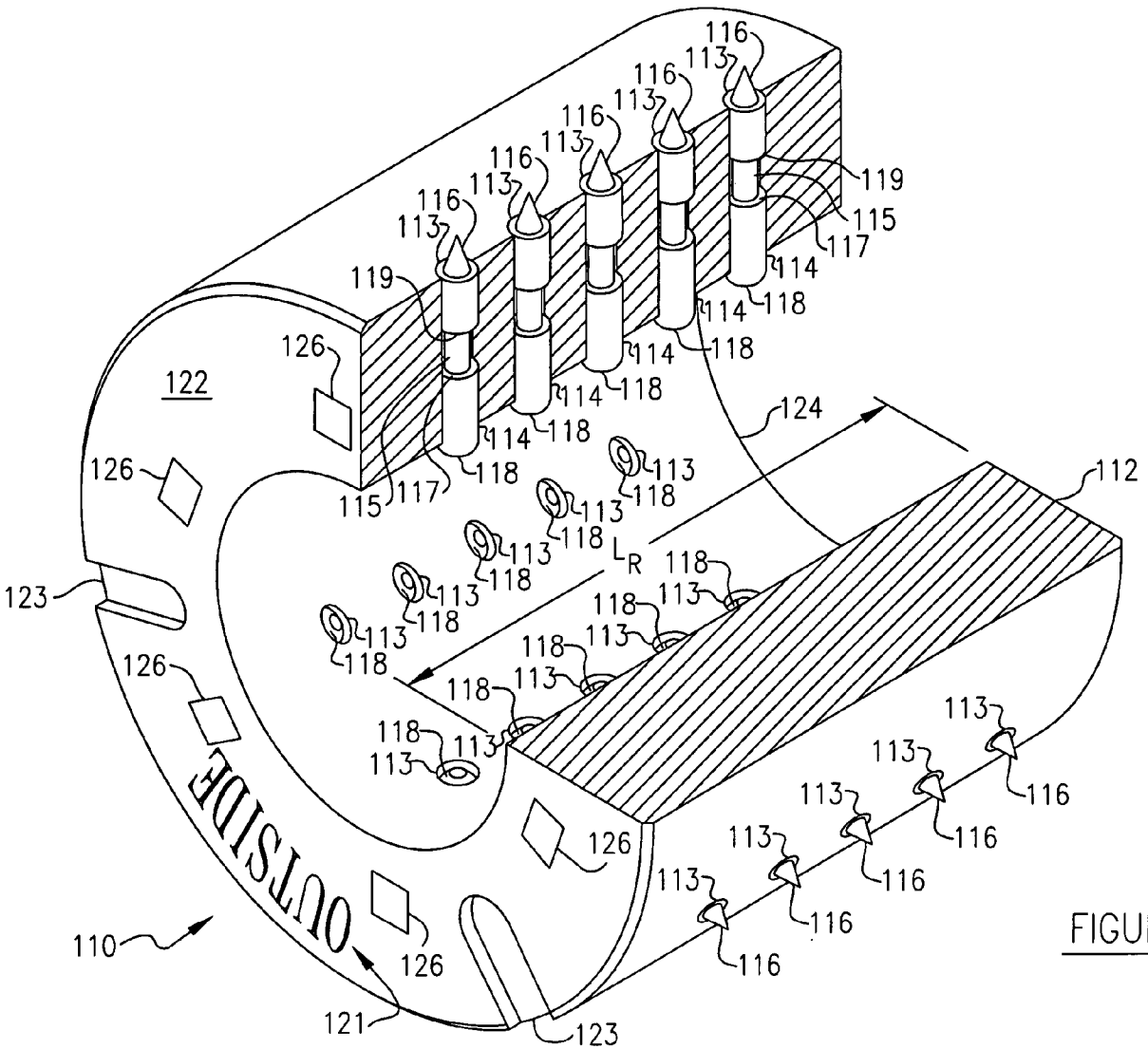
FIG. 4 shows the FIG. 3 reusable adapter with its studs extended.
Figure 5A:
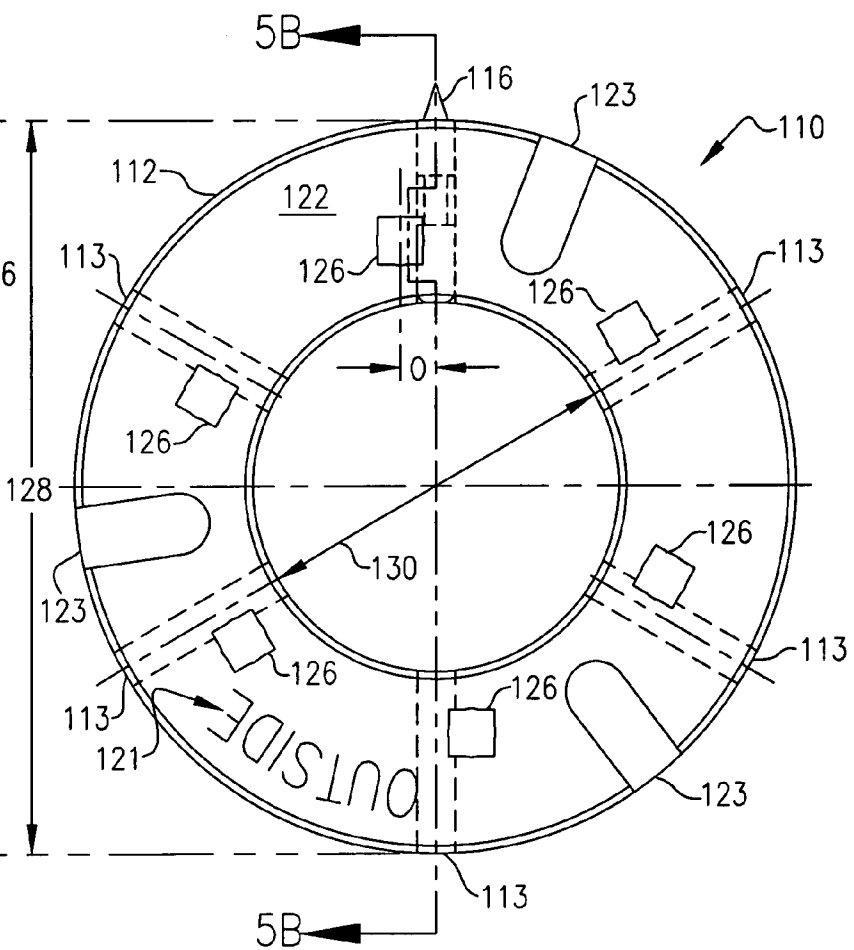
FIG. 5A is an outside end elevation view of the FIGS. 3 and 4 reusable adapter, showing one row of studs in the extended position.
Figure 5B:
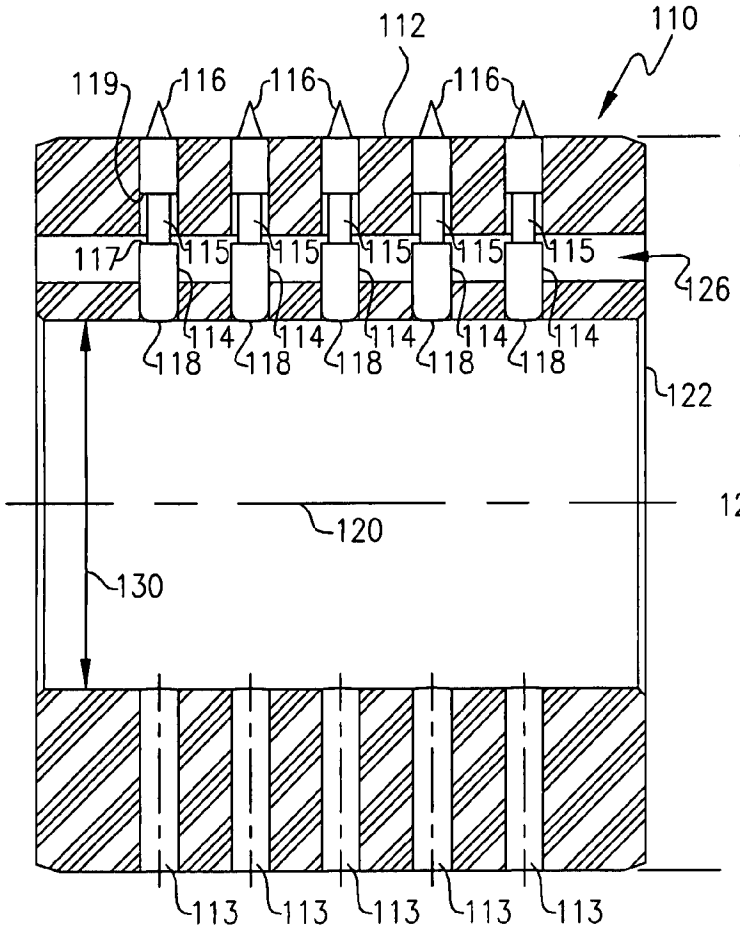
FIG. 5B is a section view taken with respect to line 5B-5B shown in FIG. 5A.

A longitudinal, rectangular cross-sectioned aperture 126 is formed through sleeve 112 adjacent each row of studs 114, substantially parallel to axis 120 and intersecting the apertures 113 in which each stud in the row is embedded. As best seen in FIG. 5A, each aperture 126 is offset by a displacement "O" relative to a notional plane containing the longitudinal axes of each stud in the row of studs adjacent that aperture; and the aperture's two side walls are substantially parallel to that plane. Each aperture 126 is located so that, when studs 114 are extended from sleeve 12 as shown in FIGS. 4 and 5B, aperture 126 partially intersects the circumferential groove 115 of each stud in the row.

Reusable adapter sleeve 112's outside diameter 128 (FIGS. 5A and 5B) is sized for light friction-fit, non-adhesive insertion into a standard 6-inch inside diameter paper roll core. Reusable adapter sleeve 112's inside diameter 130 is sized to the same tolerances as a standard 3-inch inside diameter paper roll core. Reusable adapter 110 can have any reasonable length (e.g. about 5 inches) to accommodate different core chuck designs.

Unlike reusable adapter 110, disposable adapter 10 has no longitudinal apertures extending between and through sleeve 12's outward and inward ends 22, 24 and between outside and inside diameters 22, 30. That is, disposable adapter 10 has no apertures corresponding to reusable adapter 110's apertures 126. Disposable adapter 10's studs 14 have no central circumferential groove corresponding to grooves 115 of reusable adapter 110's studs 114. Persons skilled in the art will understand that studs 114 can, if desired, be used in disposable adapter 10 although grooves 115 serve no purpose if studs 114 are used in disposable adapter 10.

Adapter Insertion Tool

Figure 6:
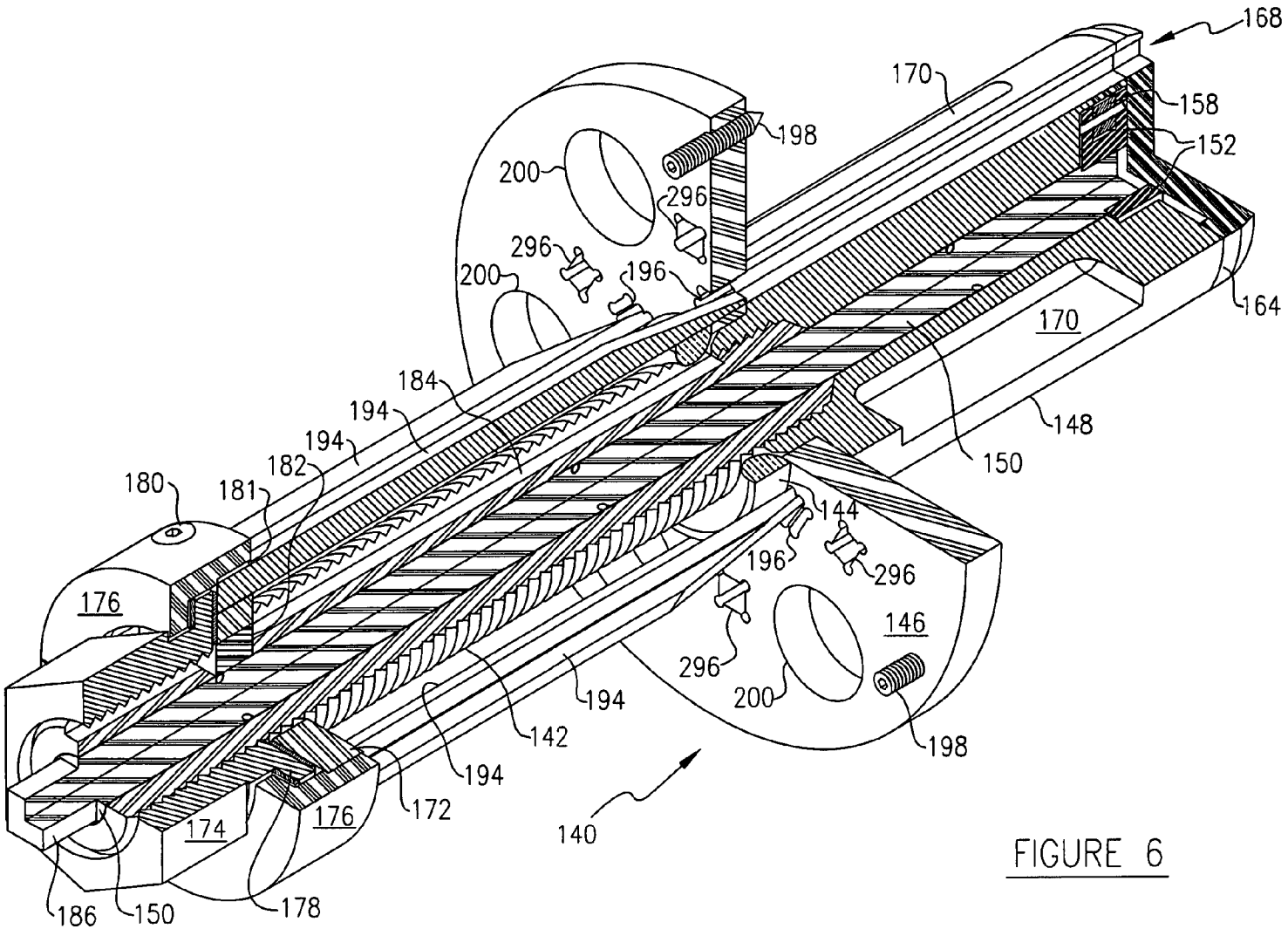
FIG. 6 is a partially sectioned isometric view of a tool for inserting either the disposable core adapter or the reusable core adapter into a roll core.

FIG. 6 depicts a tool 140 for inserting either one of disposable core adapter 10 or reusable core adapter 110 into a paper roll core (not shown in FIG. 6). As used herein, "inward" means toward the right, as viewed in FIG. 6; and "outward" means toward the left, as viewed in FIG. 6. Tool 140 has a longitudinally apertured, externally threaded rod 142 which extends through central apertures in each of Delrin™ spacer plate 144 and stop flange 146 (spacer plate 144 is optional). The inward end of rod 142 is threaded into the outward end of adapter mounting mandrel 148 and welded or otherwise fastened to stop flange 146. The outside diameter of mandrel 148 is slightly less than sleeve 112's inside diameter 130 to permit easily slidable mounting of adapter 110 on mandrel 148.

Figure 8:
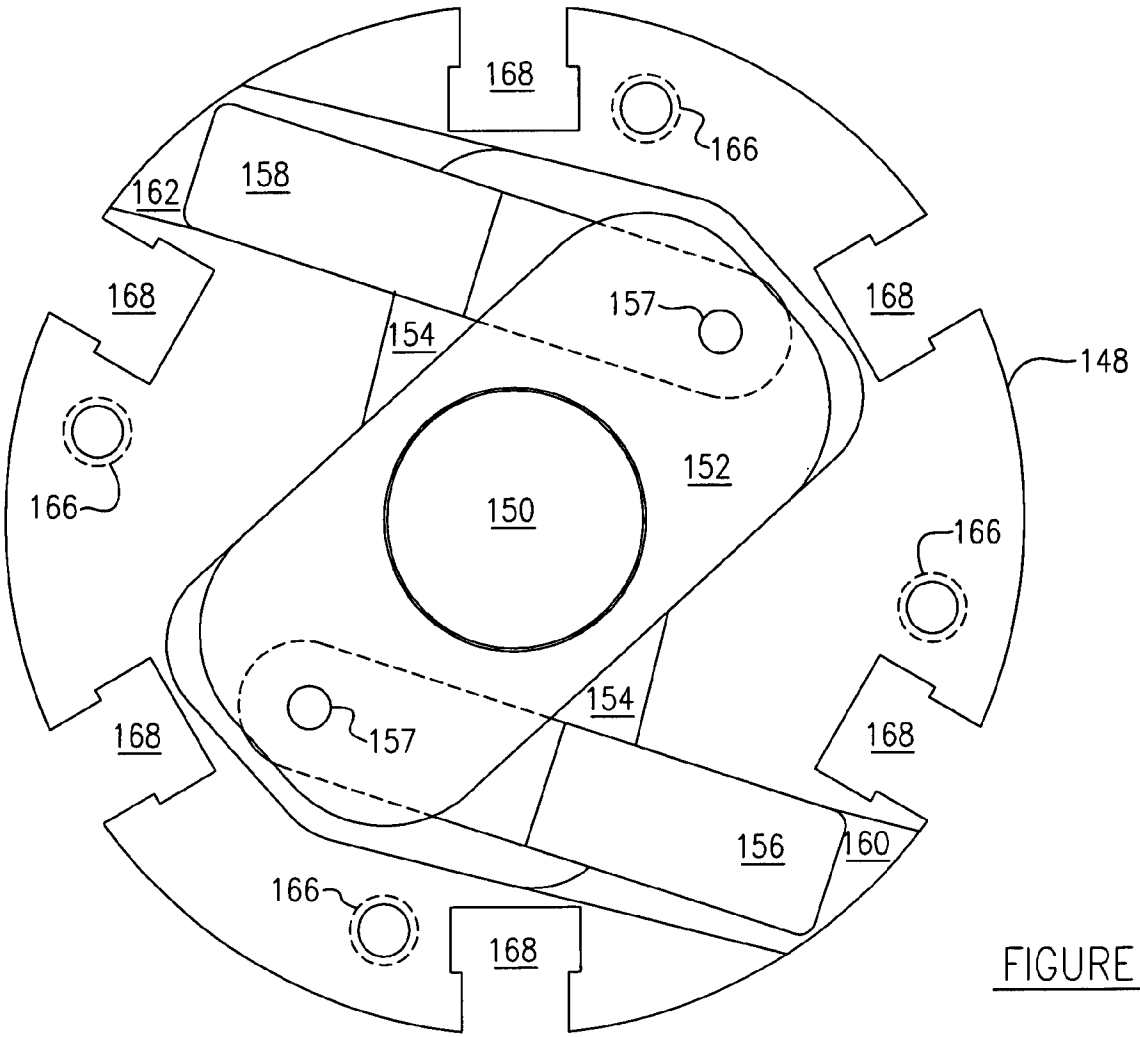
FIG. 8 is an inward end elevation view, on an enlarged scale, of either one of the tools depicted in FIG. 6 or 7, with the end cap removed and the locking pins retracted.
Figure 9:
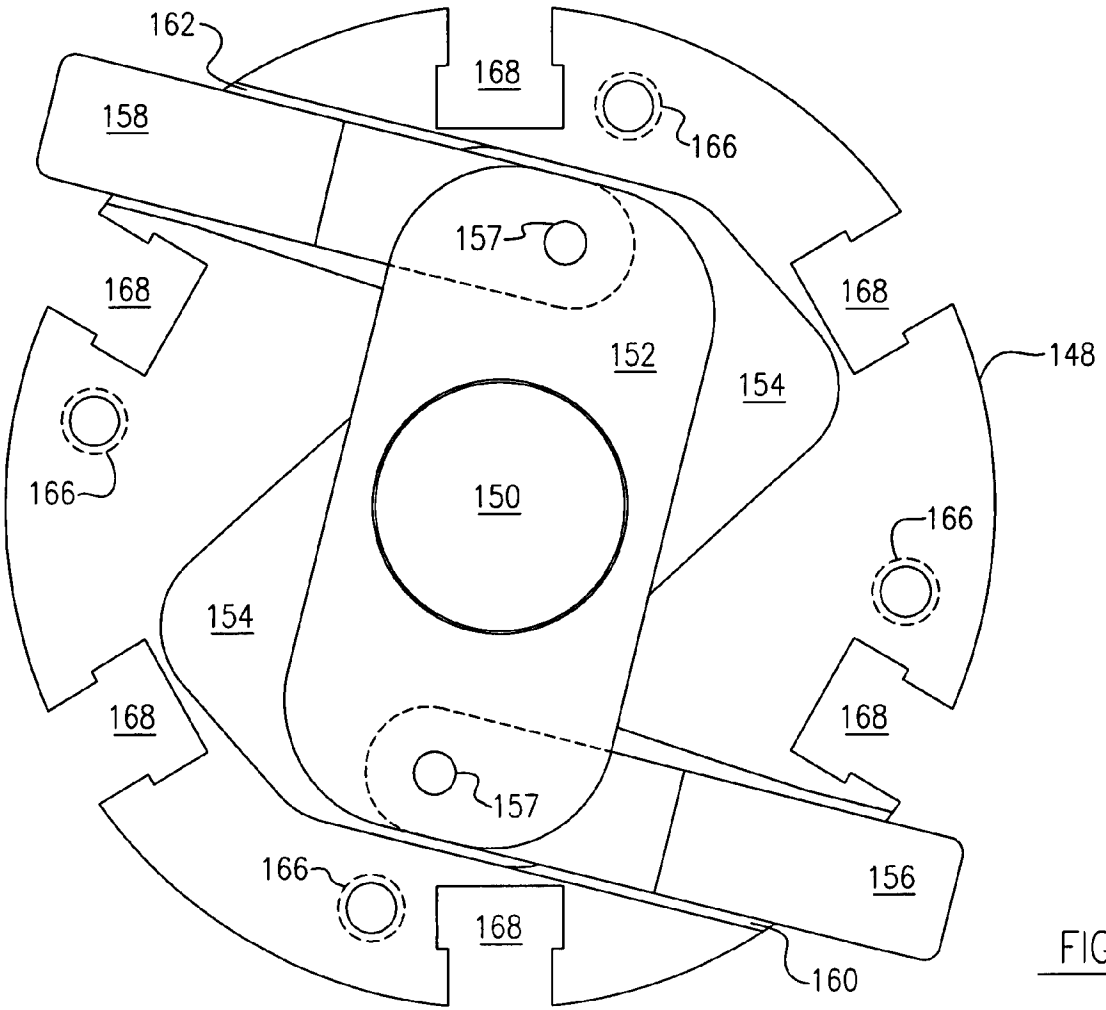
FIG. 9 is an inward end elevation view, on an enlarged scale, of either one of the tools depicted in FIG. 6 or 7, with the end cap removed and the locking pins extended.

Lock arm shaft 150 is rotatably mounted in and extends through rod 142's central longitudinal aperture. Lock arm shaft 150 projects from the inward end of rod 142 and extends through mandrel 148. As best seen in FIGS. 8 and 9, the inward end of lock arm shaft 150 is fixed to locking pin arm 152 which extends within chamber 154 machined in the inward end of mandrel 148. Locking pins 156, 158 are pivotally attached, by pivot pins 157, to opposed ends of locking pin arm 152 and extend, respectively, into apertures 160, 162 machined in the inward end of mandrel 148. Apertures 160, 162 intersect chamber 154. Lock arm shaft 150 is selectably rotated as explained below to move locking pin arm 152 into the position shown in FIG. 8 in which locking pins 156, 158 are retracted within mandrel 148; or, to move arm 152 into the position shown in FIG. 9 in which locking pins 156, 158 project from mandrel 148. Locking pins 156, 158 have wide, flat outward faces with radiused edges. Mandrel 148 is sized so that its longitudinal displacement between the inward face of stop flange 146 and the outward edges of locking pins 156, 158 is slightly greater than the length "$L_D$" (FIG. 1) of disposable adapter 10 and slightly greater than the length "$L_R$" (FIG. 4) of reusable adapter 110. O-rings surround shaft 150 at spaced intervals, to provide friction-fit engagement between rod 142 and shaft 150 and resist loosening of shaft 150 when tool 140 is operated as explained below.

End cap 164 (FIG. 6) is fastened to mandrel 148 by machine screws (not shown) which threadably engage apertures 166 (FIGS. 8 and 9) in mandrel 148. A plurality of circumferentially spaced, longitudinally extending channels 168 are machined in mandrel 148. One channel 168 is provided for each row of studs 14, 114 in adapters 10, 110 respectively. Each channel 168 has an inverted-T cross-sectional shape, as seen in FIGS. 8 and 9. Optional weight-reduction channels 170 (FIG. 6) can be machined in mandrel 148. End cap 164 is made sufficiently thick (e.g. about 0.5 inches, or about 1.27 cm) to be capable of securely retaining locking pins 156, 158 when one of adapters 10 or 110 is driven into a paper roll core as explained below.

Figure 10:
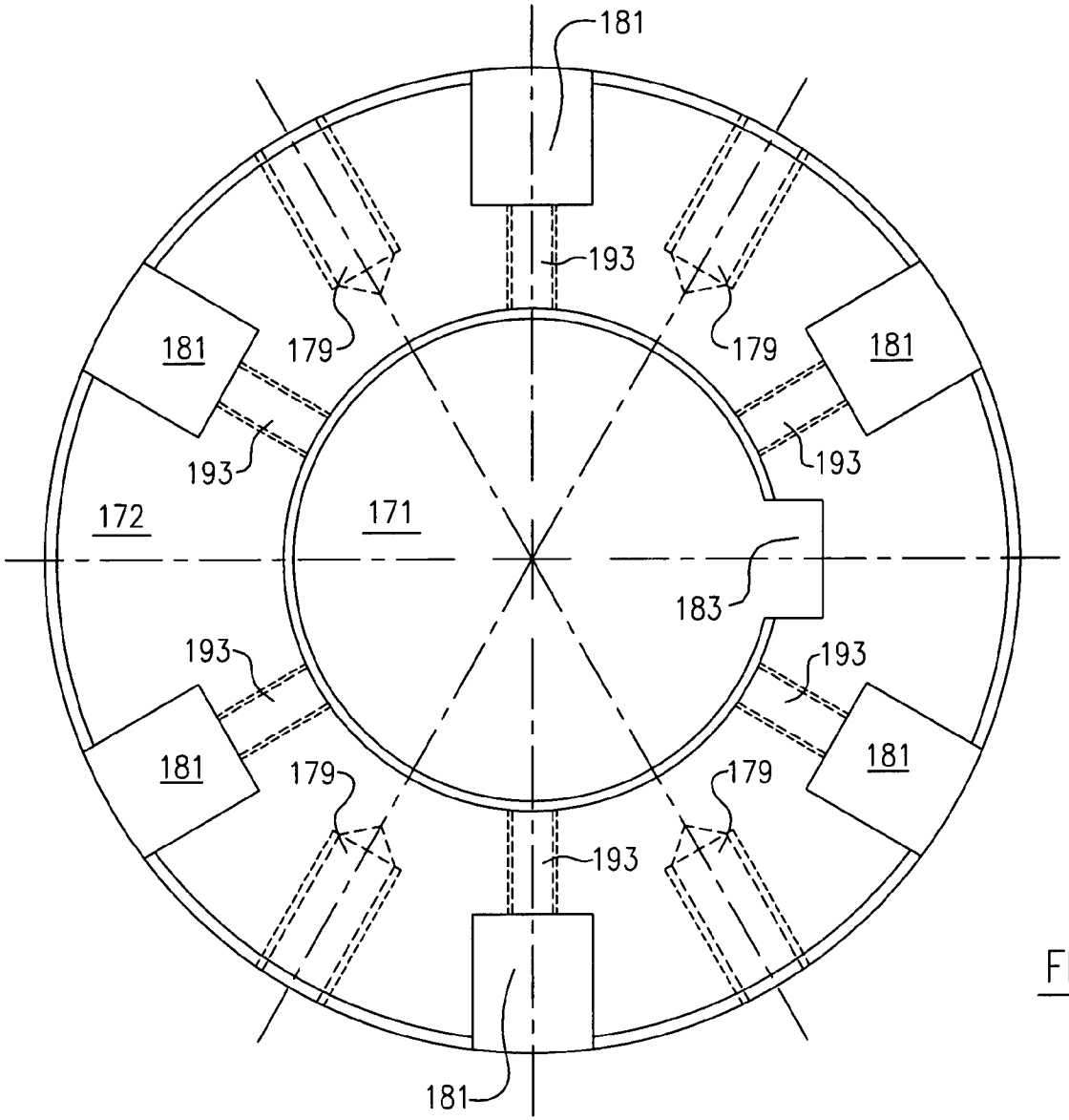
FIG. 10 is an inward end elevation view of the drive flange portion of the FIG. 6 tool.

The outward end of rod 142 extends through a central keyway aperture 171 (FIG. 10) in drive flange 172 and is threaded into drive nut 174. Keeper plate 176 is diametrically split into two halves which are fitted over drive nut 174's capture flange 178 and fastened to drive flange 172 by machine screws 180 which threadably engage apertures 179 (FIG. 10) in drive flange 172. A plurality of circumferentially spaced slots 181 are machined in drive flange 172. One slot 181 is provided for each row of studs 114 provided in sleeve 112. Each slot 181 has a rectangular cross-sectional shape, aligned with a corresponding one of channels 168. The circle (not shown) used to locate channels 168 machined in mandrel 148 is the same as the circle (not shown) used to machine slots 181 in drive flange 172. The circumferential displacement around the circle of channels 168 machined in mandrel 148 is the same as the circumferential displacement around the circle of slots 181 machined in drive flange 172. Key 182 extends into drive flange 172's keyway aperture 183 and into external keyway 184 machined in rod 142, maintaining alignment of drive flange 172 relative to stop flange 146 when drive nut 174 is rotated or counter-rotated as explained below. The squared outward end 186 of lock arm shaft 150 projects outwardly through rod 142's outward end.

A wedge-tipped bar 194 having an inverted-T cross-sectional shape matching that of channels 168 and slots 181 is provided for each one of slots 181 (and thus for each row of studs 14 or 114 provided in sleeves 12 or 112 respectively). The wedge face on each bar 194 has a smooth surface finish to reduce friction and is machined to gradually merge into the bar's narrow top face, opposite the bar's wider bottom face. Advantageously, the wedge face on each bar 194 is heat treated to increase surface hardness for wear resistance, while preserving ductility of the remainder of each bar 194 to inhibit breakage. The inward end of each bar 194 is preferably rounded to prevent the bar from digging into the non-apertured portion of adapter 10 or 110 during installation. The outward end of each bar 194 is fastened into one of drive flange 172's slots 181 by machine screws (not shown) which threadably engage apertures 193 (FIG. 10), care being taken to align bars 194 substantially perpendicular to the inward face of drive flange 172, with each bar's sloped wedge surface facing radially toward the outer circumferential rim of drive flange 172 and the bar's wider bottom face facing radially away from the outer circumferential rim of drive flange 172. The inward (i.e. wedge-tipped) ends of each bar 194 extend through a corresponding one of rectangular apertures 196 machined in stop flange 146. The circle (not shown) used to locate apertures 196 is the same as the circle (not shown) used to locate channels 168 machined in mandrel 148. The circumferential displacement around the circle of apertures 196 is the same as the circumferential displacement around the circle of channels 168 machined in mandrel 148. Consequently, any one of apertures 196 is coaxially alignable with any one of channels 168. When rod 142 is attached to stop flange 146 as aforesaid, care is taken to maintain coaxial alignment of each one of apertures 196 with a corresponding one of drive flange 172's slots 181. A plurality of (e.g. three) circumferentially spaced set screws 198 are threadably mounted in and extend through apertures machined in stop flange 146. Optional weight-reduction apertures 200 can be machined in stop flange 146. Optional spacer plate 144 assists in guiding bars 194 through apertures 196 when drive nut 174 is rotated or counter-rotated as explained below. Spacer plate 144 also serves as a cushioned depth stop for drive flange 172.

Reusable Core Adapter Removal Tool

Figure 7:
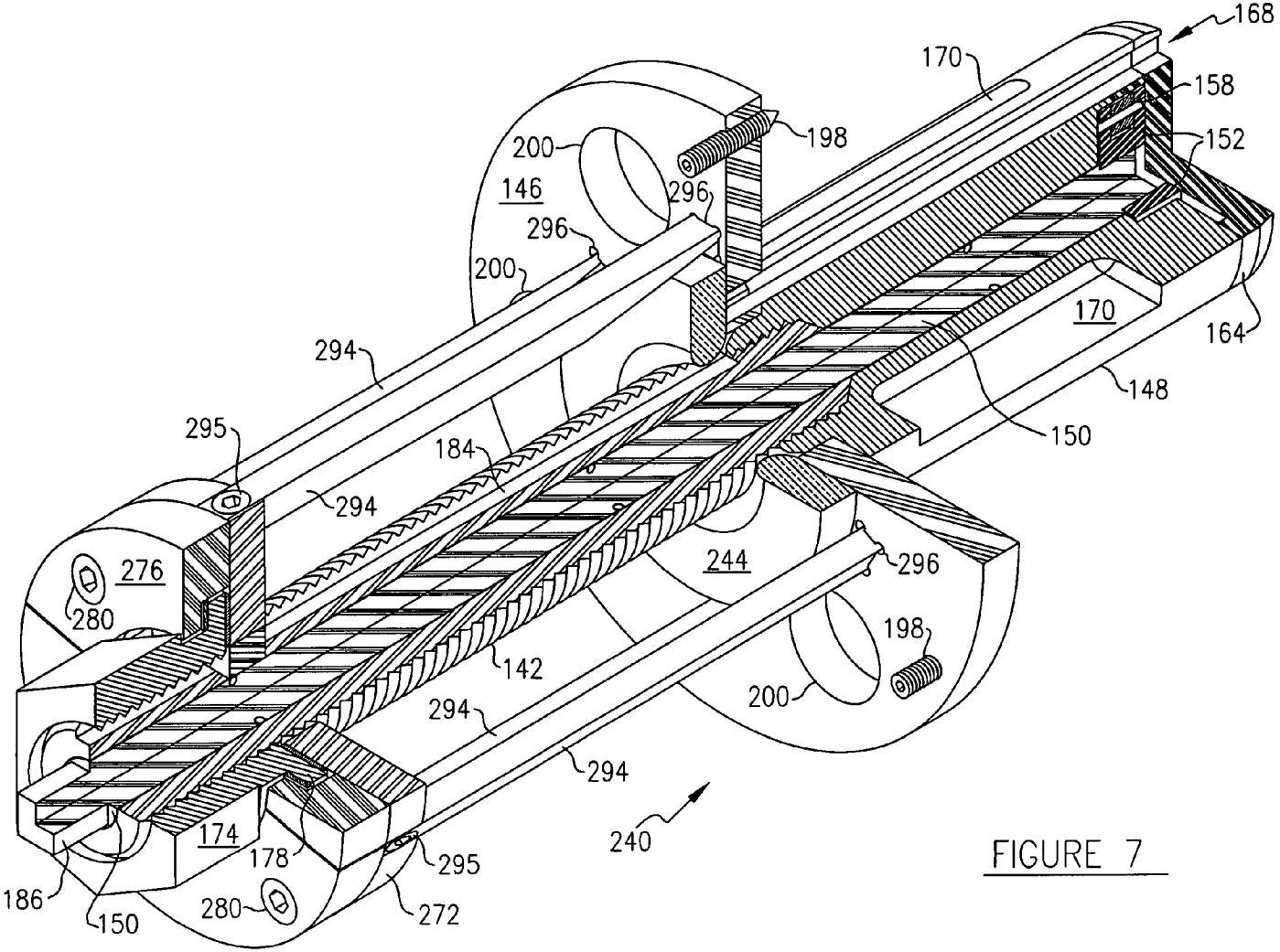
FIG. 7 is a partially sectioned isometric view of a tool for removing the reusable core adapter from a roll core.

FIG. 7 depicts a tool 240 for removing from a paper roll core (not shown in FIG. 7) a reusable core adapter 110 previously inserted into the core by tool 140. Comparison of FIGS. 6 and 7 will reveal that tools 140, 240 are structurally similar. Components which are common to tools 140, 240 bear the same reference numerals in FIGS. 6 and 7 and need not be described further. As used herein, "inward" means toward the right, as viewed in FIG. 7; and "outward" means toward the left, as viewed in FIG. 7.

Figure 11:
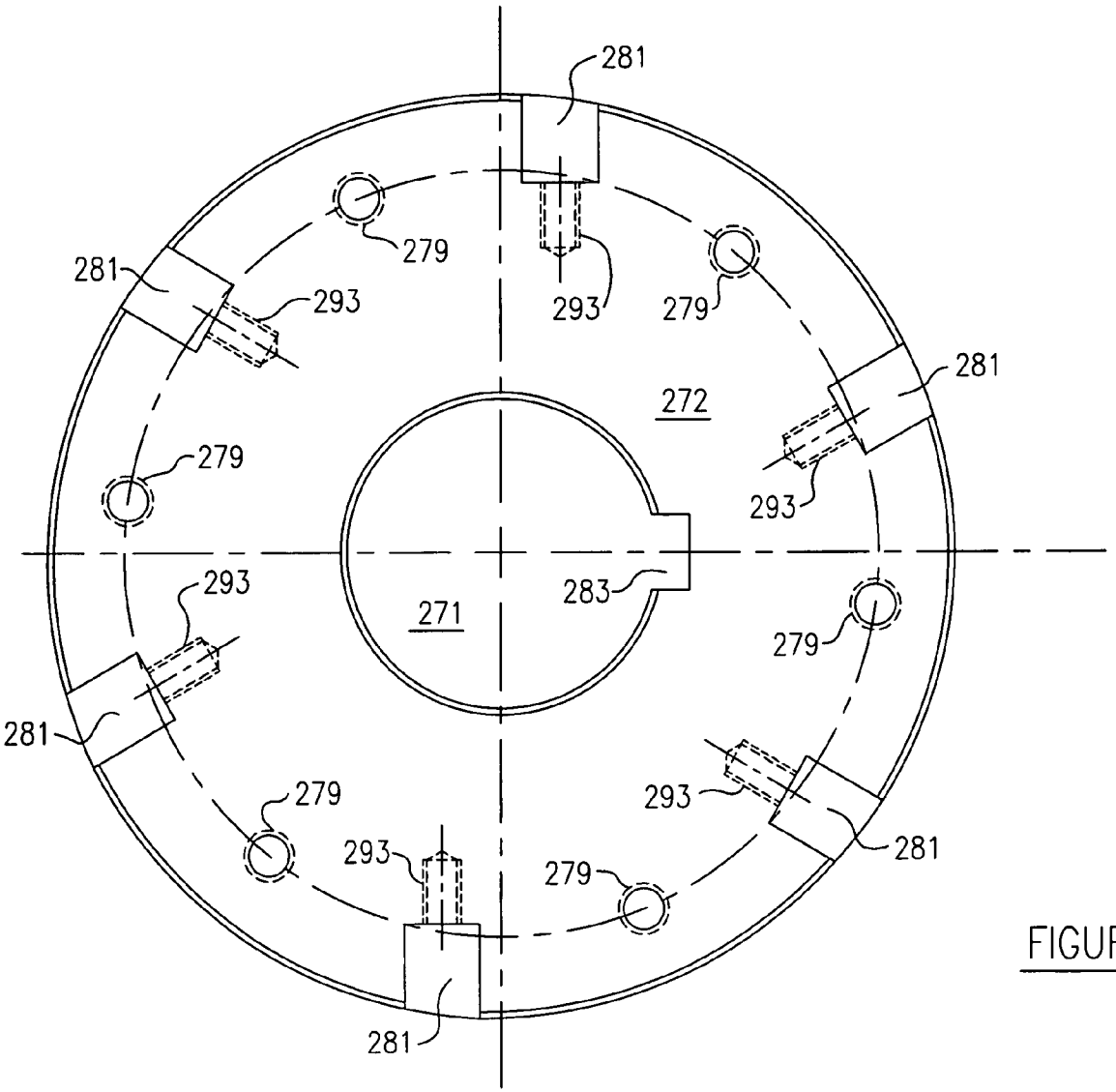
FIG. 11 is an inward end elevation view of the drive flange portion of the FIG. 7 tool.

Keeper plate 276 is diametrically split into two halves which are fitted over drive nut 174's capture flange 178 and fastened to drive flange 272 by machine screws 280 which threadably engage apertures 279 (FIG. 11) in drive flange 272. A plurality of circumferentially spaced slots 281 are machined in drive flange 272. One slot 281 is provided for each row of studs 114 provided in sleeve 112. Each slot 281 has a rectangular cross-sectional shape. The circle (not shown) used to locate slots 281 machined in drive flange 172 is the same as the circle (not shown) used to locate apertures 126 formed in adapter 110. The circumferential displacement of slots 281 around the circle is the same as the circumferential displacement of apertures 126 around the circle. Key 182 extends into drive flange 272's keyway aperture 283 and into external keyway 184 machined in rod 142, maintaining alignment of drive flange 272 relative to stop flange 146 when drive nut 174 is rotated or counter-rotated as explained below.

A wedge-tipped bar 294 having a rectangular cross-sectional shape matching that of apertures 126 and slots 281 is provided for each one of slots 181 (and thus for each for each row of studs 114 provided in sleeve 112). The wedge tip on each bar 294 has a smooth surface finish to reduce friction and is machined to gradually merge into one of the bar's flat sides. Advantageously, the wedge tip on each bar 294 is heat treated to increase surface hardness for wear resistance, while preserving ductility of the remainder of each bar 294 to inhibit breakage. The inward end of each bar 294 is preferably rounded to prevent the bar from digging into the non-apertured portion of adapter 110 during installation. The outward end of each bar 294 is fastened into one of drive flange 272's slots 281 by one of machine screws 295 which threadably engage apertures 293 (FIG. 11), care being taken to align bars 294 substantially perpendicular to the inward face of drive flange 272, with each bar's sloped wedge surface facing radially away from the outer circumferential rim of drive flange 272. The inward (i.e. wedge-tipped) ends of each bar 294 extend through a corresponding one of rectangular apertures 296 machined in stop flange 146. The circle (not shown) used to locate apertures 296 is the same as the circle (not shown) used to locate sleeve 112's apertures 126. The circumferential displacement of apertures 296 around the circle is the same as the circumferential displacement around the circle of apertures 126 formed through sleeve 112. Consequently, any one of apertures 296 is coaxially alignable with any one of the sleeve 112's apertures 126. When rod 142 is attached to stop flange 146 as aforesaid, care is taken to maintain coaxial alignment of each one of apertures 296 with a corresponding one of drive flange 272's slots 281. Each aperture 126 in sleeve 112 is diametrically sized for snug-fit passage of one of bars 294 through aperture 126 as explained below. Optional spacer plate 244 assists in guiding bars 294 through apertures 296 when drive nut 174 is rotated or counter-rotated as explained below. Spacer plate 244 also serves as a cushioned stop for drive flange 272.

Installation of Disposable Core Adapter

In operation, a disposable core adapter 10 (with studs 14 retracted as shown in FIG. 1) is slidably fitted over tool 140's mandrel 148 by aligning the bottom ends 18 in each row of studs 14 within a corresponding one of channels 168 to position either one of adapter 10's ends 22 or 24 flush against the inward face of stop flange 146. A wrench is then used to rotate lock arm shaft 150's squared outward end 186 clockwise (as viewed from the left side of FIG. 6). Such rotation of lock arm shaft 150 rotates locking pin arm 152 counter-clockwise (as viewed in FIGS. 8 and 9), moving locking pin arm 152 and locking pins 156, 158 into the position shown in FIG. 9 in which locking pins 156, 158 project from mandrel 148, thereby snugly capturing disposable adapter 10 between stop flange 146 and locking pins 156, 158. The radiused edges of locking pins 156, 158 cam movement of the locking pins over adapter 10's inward end 24, reducing potential jamming of the locking pins against the adapter. The locking pins' wide, flat outward faces bear securely against the adapter's inward end without indenting that end when the adapter is driven into a paper roll core as explained below.

Figure 12A:
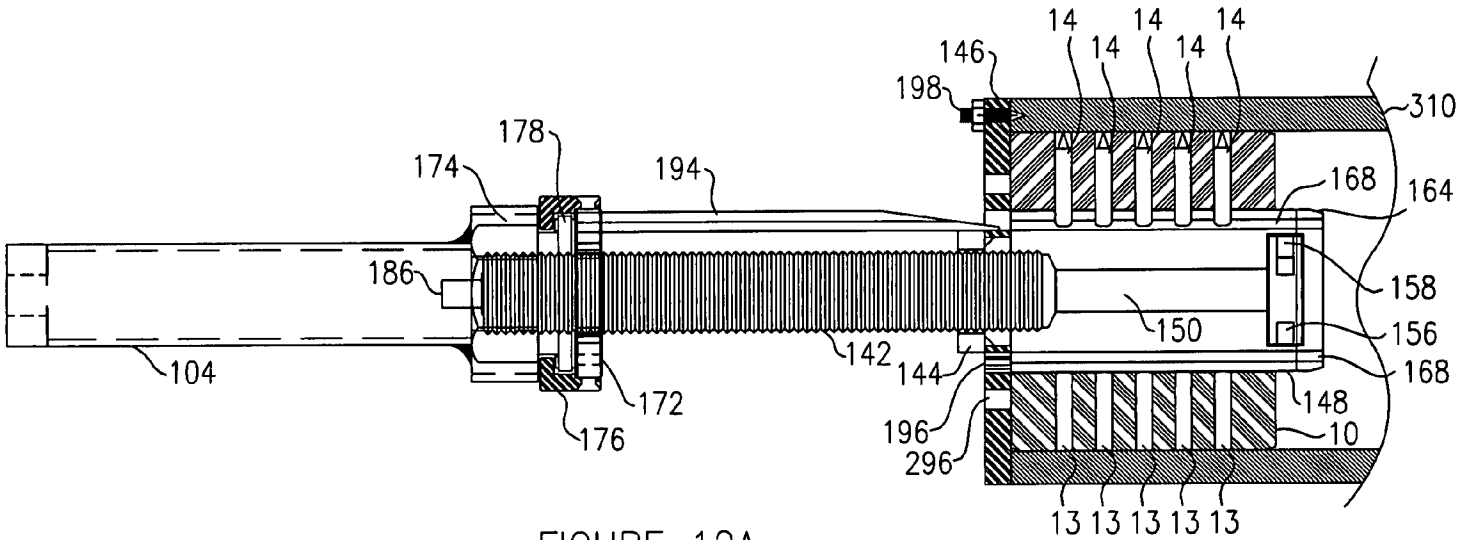
FIG. 12A is a schematic, partially sectioned, side elevation assembly view of the FIG. 6 adapter insertion tool engaging one end of a paper roll after insertion of a disposable core adapter into the roll's core, showing the insertion tool positioned to commence driving the disposable adapter's studs into the core.
Figure 12B:
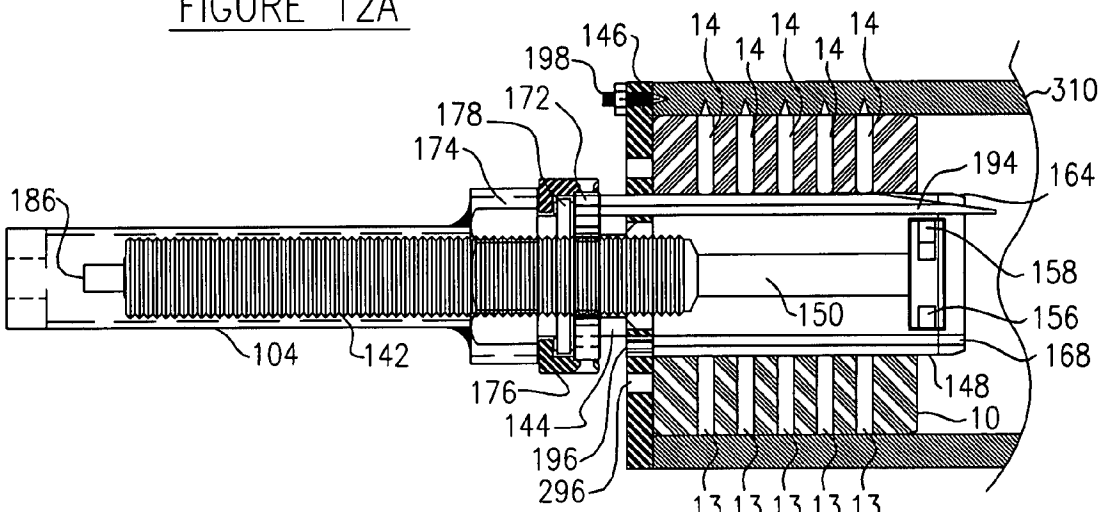
FIG. 12B depicts the FIG. 12A apparatus after actuation of the adapter insertion tool to drive the disposable adapter's studs into the core.

As shown in FIGS. 12A and 12B, the inward end of core adapter insertion tool 140 (i.e. the end on which disposable core adapter 10 is captively mounted as aforesaid) is then inserted into one end of 6-inch paper roll core 310, until the inward face of stop flange 146 circumferentially surrounding adapter 10 is flush against the outward end of paper roll 312. This action forces the pointed tips of set screws 198 into core 310, preventing rotation of tool 140 and adapter 10 relative to core 310. Locking pins 156, 158 brace adapter 10's inward end, limiting the depth to which adapter 10 can be axially inserted into core 310—if adapter 10's outward end is inserted beyond the outward end of core 310 it could be difficult to remove adapter 10 from core 310. One end of a deep socket 104 is then fitted over drive nut 174. The socket's opposite end is coupled to a torque multiplier (not shown). The torque multiplier is actuated to rotate drive nut 174 so as to threadably advance drive nut 174 along rod 142 toward the rod's inward end (i.e. toward the right, as viewed in FIGS. 12A and 12B). Since drive nut 174's capture flange 178 is enclosed between drive flange 172 and keeper plate 176, such advancement of drive nut 174 advances drive flange 172 and keeper plate 176 along rod 142, toward the rod's inward end. More particularly, such advancement of drive nut 174 drives each one of bars 194 through a corresponding one of stop flange 146's apertures 196 and into a corresponding one of channels 168. The aforementioned engagement of key 182 within drive flange 172's keyway 183 and within rod 142's keyway 184 maintains alignment of drive flange 172 relative to stop flange 146 as bars 194 are driven into apertures 142.

When the wedge-tipped inward end of a bar 194 reaches the rounded bottom 18 of the outwardmost one of studs 14 within one of channels 168, the wedge tip slides easily beneath rounded bottom 18. As bar 194 is driven further into channel 168, the wedge tip is forced against rounded bottom 18, driving stud 14 substantially perpendicularly away from adapter 10's longitudinal axis 20. This in turn drives stud 14's tip 16 into core 310. Operation of the torque multiplier is continued to simultaneously drive each bar 194 completely into a corresponding one of channels 168, until the inward face of drive flange 172 contacts the outward face of stop flange 146 (or spacer 144—if provided). The studs 14 in each row are thus successively driven into core 310, from the retracted position shown in FIGS. 1 and 12A into the extended position shown in FIGS. 2 and 12B. The studs' penetration depth into core 310 is determined by the width of bar 194, thus avoiding over-penetration of the studs which could distort the outer surface of core 310. As previously explained, within each row, each stud is coplanar with one stud in each one of the other rows. Accordingly, simultaneous driving of bars 194 into channels 168 successively drives each group of coplanar studs simultaneously into core 310, thereby maintaining concentric alignment of adapter 10 within core 310 to prevent off-axis rotation of core 310 during high speed unwinding of material from core 310. Longitudinal and transverse deflection of each bar 194 relative to its corresponding channel 168 is prevented since the wide base of each bar 194 is restrained within the wide, lower portion of the corresponding inverted-T cross-sectionally shaped channel 168.

After adapter 10 has been fully installed in core 310 (i.e. after all of studs 14 have been extended as shown in FIGS. 2 and 12B) the torque multiplier is adjusted to reverse its drive direction, then actuated to rotate drive nut 174 so as to threadably retract drive nut 174 along rod 142 toward the rod's outward end, thereby retracting bars 194 along channels 168 until the bars' wedge tips clear adapter 10's outward face 22. A wrench is then used to rotate lock arm shaft 150's squared outward end 186 counter-clockwise (as viewed from the left side of FIG. 6). Such rotation of lock arm shaft 150 rotates locking pin arm 152 clockwise (as viewed in FIGS. 8 and 9), moving locking pin arm 152 and locking pins 156, 158 into the position shown in FIG. 8 in which locking pins 56, 58 are retracted within mandrel 148. Core adapter insertion tool 140 is then withdrawn from core 310, leaving disposable adapter 10 within core 310. Another disposable adapter 10 is then fitted onto tool 140 and inserted into the opposite end of core 310. That adapter's studs are then driven into core 310 as described above.

When driven into core 310 as aforesaid, studs 14 robustly couple adapter 10 to core 310, so as to withstand core chuck axial thrust loads and resist acceleration and deceleration torques applied to a paper roll (not shown) wound on core 310 during typical operation of a press room reel stand. When the reel stand's core chucks (not shown—there are many different core chuck configurations) engage core 310, the core chuck's body butts against the underside of some or all rows of studs 14, preventing retraction of studs 14 from core 310 during unwinding of the roll. Because disposable adapter 10's sleeve 12 is flangeless, no protrusions remain after adapter 10 is installed in core 310, so the width of the paper roll is unaffected by adapter 10. Paper rolls in which disposable adapters 10 have been installed can also be safely stacked on end. Core adapter insertion tool 140 facilitates fast, efficient installation of disposable core adapters 10. Tool 140's simultaneous, symmetric radial engagement of studs 14 ensures concentric installation of each adapter 10 within core 310. Unlike prior art adapters which must be recovered from the spent core after the paper roll is unwound, disposable adapter 10 is discarded with the spent core, avoiding potentially expensive, time consuming adapter recovery procedures.

Installation of Reusable Core Adapter

In operation, a reusable core adapter 110 (with studs 114 retracted as shown in FIG. 3) is slidably fitted over tool 140's mandrel 148 by aligning the bottom ends 118 in each row of studs 114 within a corresponding one of channels 168 to position adapter 110's outward end 122 (i.e. the end bearing "OUTSIDE" label 121) flush against the inward face of stop flange 146. A wrench is then used to rotate lock arm shaft 150's squared outward end 186 clockwise (as viewed from the left side of FIG. 6). Such rotation of lock arm shaft 150 rotates locking pin arm 152 counter-clockwise (as viewed in FIGS. 8 and 9), moving locking pin arm 152 and locking pins 156, 158 into the position shown in FIG. 9 in which locking pins 156, 158 project from mandrel 148, thereby snugly capturing reusable adapter 110 between stop flange 146 and locking pins 156, 158. The radiused edges of locking pins 156, 158 cam movement of the locking pins over adapter 110's inward end 124, reducing potential jamming of the locking pins against the adapter. The locking pins' wide, flat outward faces bear securely against the adapter's inward end without indenting that end when the adapter is driven into a paper roll core as explained below.

Figure 13:
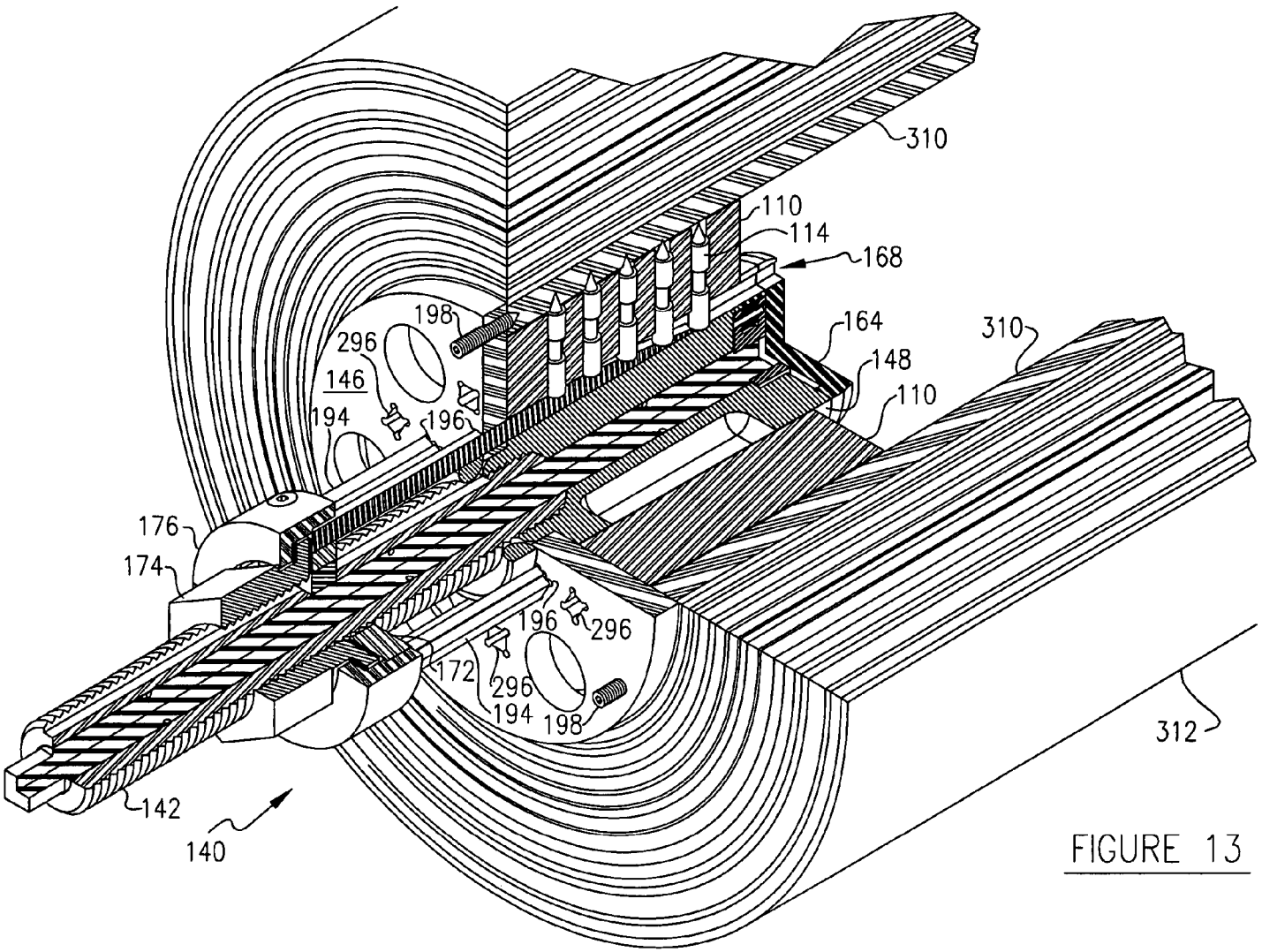
FIG. 13 is a partially sectioned isometric view of the FIG. 6 adapter insertion tool engaging one end of a paper roll after insertion of a reusable core adapter into the roll's core and after actuation of the insertion tool to commence driving the reusable adapter's studs into the core.
Figure 15A:
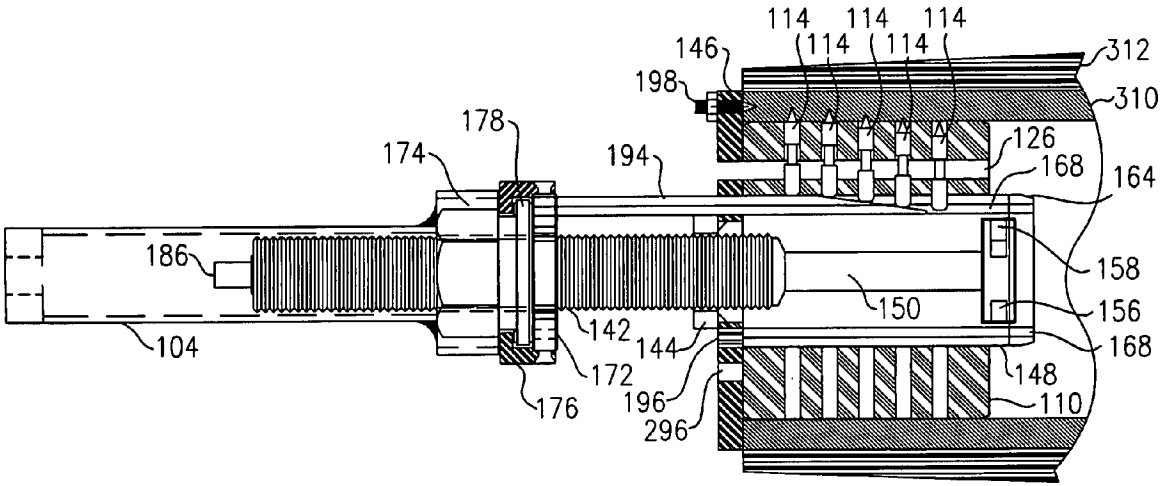
FIG. 15A is a schematic, partially sectioned, side elevation assembly view of the apparatus depicted in FIG. 13.

As shown in FIGS. 13 and 15A, the inward end of core adapter insertion tool 140 (i.e. the end on which reusable core adapter 110 is captively mounted as aforesaid) is then inserted into one end of 6-inch paper roll core 310, until the inward face of stop flange 146 circumferentially surrounding adapter 110 is flush against the outward end of paper roll 312. This action forces the pointed tips of set screws 198 into core 310, preventing rotation of tool 140 and adapter 110 relative to core 310. Locking pins 156, 158 brace adapter 110's inward end, limiting the depth to which adapter 110 can be axially inserted into core 310—if adapter 110's outward end is inserted beyond the outward end of core 310 it could be difficult to remove adapter 110 from core 310. One end of a deep socket 104 is then fitted over drive nut 174. The socket's opposite end is coupled to a torque multiplier (not shown). The torque multiplier is actuated to rotate drive nut 174 so as to threadably advance drive nut 174 along rod 142 toward the rod's inward end (i.e. toward the right, as viewed in FIGS. 13 and 15A). Since drive nut 174's capture flange 178 is enclosed between drive flange 172 and keeper plate 176, such advancement of drive nut 174 advances drive flange 172 and keeper plate 176 along rod 142, toward the rod's inward end. More particularly, such advancement of drive nut 174 drives each one of bars 194 through a corresponding one of stop flange 146's apertures 196 and into a corresponding one of channels 168. The aforementioned engagement of key 182 within drive flange 172's keyway 183 and within rod 142's keyway 184 maintains alignment of drive flange 172 relative to stop flange 146 as bars 194 are driven into apertures 142.

When the wedge-tipped inward end of a bar 194 reaches the rounded bottom 118 of the outwardmost one of studs 114 within one of channels 168, the wedge tip slides easily beneath rounded bottom 118. As bar 194 is driven further into channel 168, the wedge tip is forced against rounded bottom 118, driving stud 114 substantially perpendicularly away from adapter 110's longitudinal axis 120. This in turn drives stud 114's tip 116 into core 310. Operation of the torque multiplier is continued to simultaneously drive each bar 194 completely into a corresponding one of channels 168, until the inward face of drive flange 172 contacts the outward face of stop flange 146 (or spacer 144—if provided). The studs 114 in each row are thus successively driven into core 310, from the retracted position shown in FIG. 3 into the extended position shown in FIG. 4. This is shown in FIGS. 13 and 15A: the two outwardmost studs have been fully driven into core 310 and the three inwardmost studs are partially driven into core 310. Specifically, the central stud (i.e. the third stud from the left) is almost fully driven into core 310, the fourth stud from the left has initially penetrated core 310 and the inward end of the wedge tip of bar 194 has just reached the inwardmost stud to commence driving that stud into core 310. The studs' penetration depth into core 310 is determined by the width of bar 194, thus avoiding over-penetration of the studs which could distort the outer surface of core 310. As previously explained, within each row, each stud is coplanar with one stud in each one of the other rows. Accordingly, simultaneous driving of bars 194 into channels 168 successively drives each group of coplanar studs simultaneously into core 310, thereby maintaining concentric alignment of adapter 110 within core 310 to prevent off-axis rotation of core 310 during high speed unwinding of roll 312 from core 310. Longitudinal and transverse deflection of each bar 194 relative to its corresponding channel 168 is prevented since the wide base of each bar 194 is restrained within the wide, lower portion of the corresponding inverted-T cross-sectionally shaped channel 168.

After adapter 110 has been fully installed in core 310 (i.e. after all of studs 114 have been extended as shown in FIG. 4) the torque multiplier is adjusted to reverse its drive direction, then actuated to rotate drive nut 174 so as to threadably retract drive nut 174 along rod 142 toward the rod's outward end, thereby retracting bars 194 along channels 168 until the bars' wedge tips clear adapter 10's outward face 122. A wrench is then used to rotate lock arm shaft 150's squared outward end 186 counter-clockwise (as viewed from the left side of FIG. 13). Such rotation of lock arm shaft 150 rotates locking pin arm 152 clockwise (as viewed in FIGS. 8 and 9), moving locking pin arm 152 and locking pins 156, 158 into the position shown in FIG. 8 in which locking pins 56, 58 are retracted within mandrel 148. Core adapter insertion tool 140 is then withdrawn from core 310, leaving reusable adapter 110 within core 310. Another reusable adapter 110 is then fitted onto tool 140 and inserted into the opposite end of core 310. That adapter's studs are then driven into the core 310 as described above.

When driven into core 310 as aforesaid, studs 114 robustly couple adapter 110 to core 310, so as to withstand core chuck axial thrust loads and resist acceleration and deceleration torques applied to paper roll 312 during typical operation of a press room reel stand. When the reel stand's core chucks (not shown—there are many different core chuck configurations) engage core 310, the core chuck's body butts against the underside of some or all rows of studs 114, preventing retraction of studs 114 from core 310 during unwinding of roll 312. Because reusable adapter 110's sleeve 112 is flangeless, no protrusions remain after adapter 110 is installed in core 310, so the width of paper roll 312 is unaffected by adapter 110. Paper rolls in which reusable adapters 110 have been installed can also be safely stacked on end. Core adapter insertion tool 140 facilitates fast, efficient installation of reusable core adapters 110. Tool 140's simultaneous, symmetric radial engagement of studs 114 ensures concentric installation of each adapter 110 within core 310. Moreover, as explained below, adapter 110 is quickly and easily removed from the spent core after paper roll 312 is unwound.

Removal of Reusable Core Adapter

Figure 14:
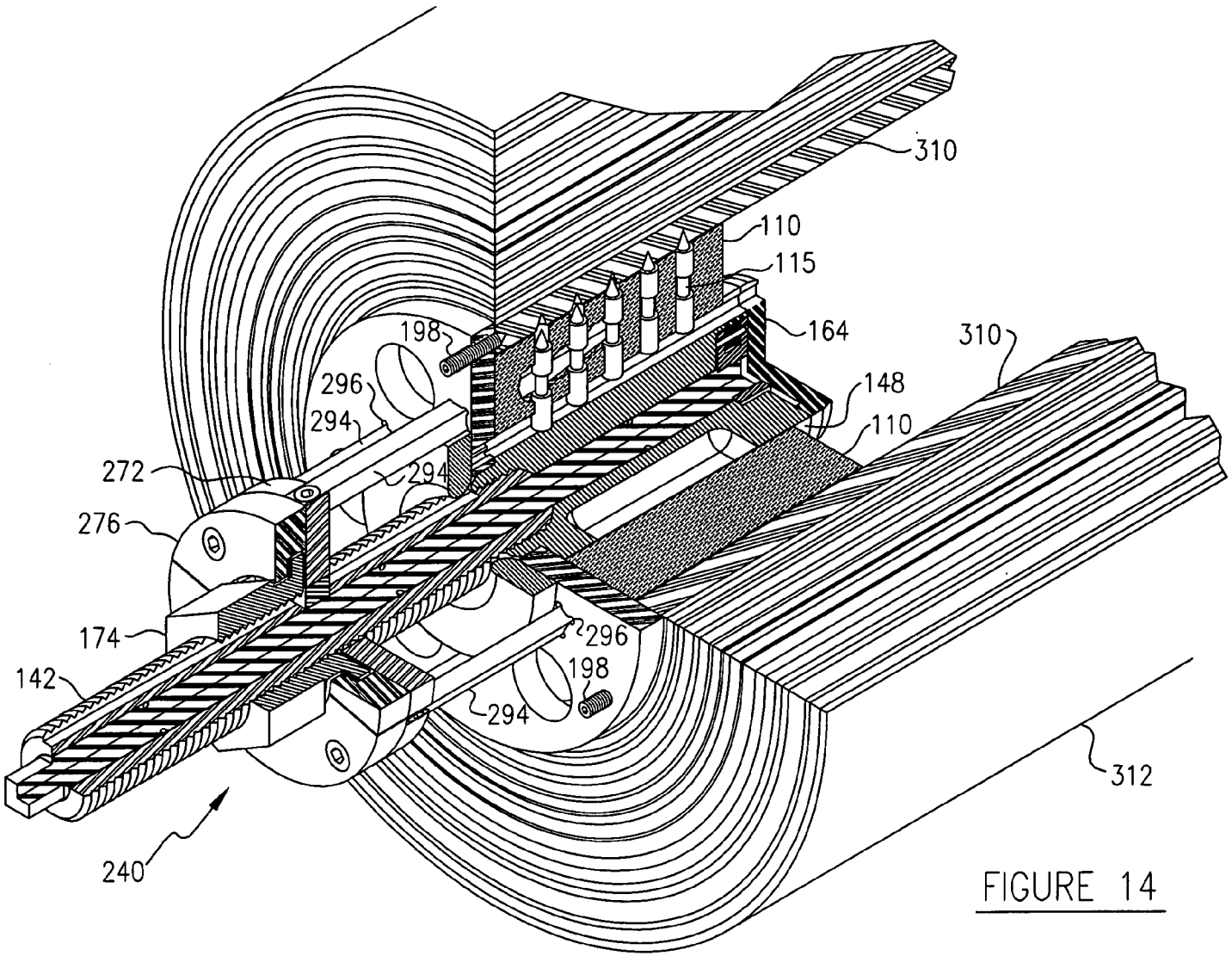
FIG. 14 is a partially sectioned isometric view of the FIG. 7 reusable adapter removal tool engaging one end of a paper roll core containing a previously inserted reusable core adapter, after actuation of the removal tool to commence withdrawal of the reusable adapter's studs from the core.
Figure 15B:
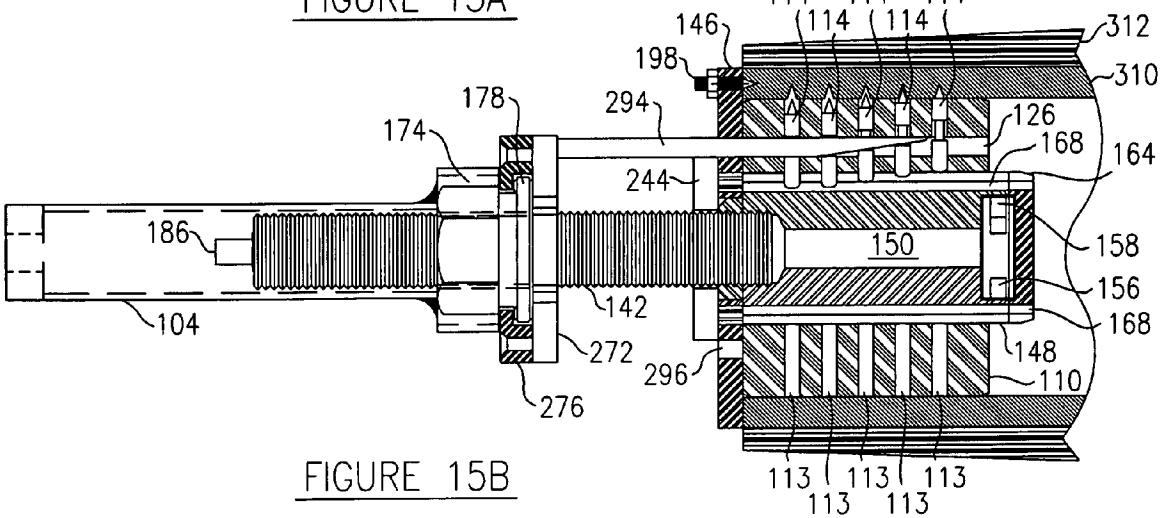
FIG. 15B is a schematic, partially sectioned, side elevation assembly view of the apparatus depicted in FIG. 14.

Reusable adapter 110 is removed from the spent core (or from a non-spent core, should such removal be necessary) with the aid of reusable core adapter removal tool 240, as shown in FIGS. 7, 14 and 15B. A wrench is used to rotate lock arm shaft 150's squared outward end 186 counter-clockwise (as viewed from the left side of FIGS. 14 and 15B). Such rotation of lock arm shaft 150 rotates locking pin arm 152 clockwise (as viewed in FIGS. 8 and 9), moving locking pin arm 152 and locking pins 156, 158 into the position shown in FIG. 8 in which locking pins 56, 58 are retracted within mandrel 148.

Mandrel 148 is then slidably advanced into the adapter's sleeve 112 until the inward face of stop flange 146 is flush against the adapter's outward end 122 (i.e. the end bearing "OUTSIDE" label 121), care being taken to align each one of stop flange 146's apertures 296 over a corresponding one of adapter 110's apertures 126. The wrench is then used to rotate lock arm shaft 150's squared outward end 186 clockwise, moving locking pin arm 152 and locking pins 156, 158 into the position shown in FIG. 9 in which locking pins 156, 158 project from mandrel 148, thereby snugly capturing adapter 110 between stop flange 146 and locking pins 156, 158. This action forces the pointed tips of set screws 198 into core 310, preventing rotation of tool 240 and adapter 110 relative to core 310. The radiused edges of locking pins 156, 158 cam movement of the locking pins over adapter 110's inward end 124, reducing potential jamming of the locking pins against the adapter. The locking pins' wide, flat outward faces bear securely against the adapter's inward end, without indenting that end when the adapter is removed from core 310 as explained below.

One end of a deep socket 104 is then fitted over drive nut 174. The socket's opposite end is coupled to an torque multiplier (not shown). The torque multiplier is actuated to rotate drive nut 174 so as to threadably advance drive nut 174 along rod 142 toward the rod's inward end (i.e. toward the right, as viewed in FIGS. 14 and 15B). Since drive nut 174's capture flange 178 is enclosed between drive flange 272 and keeper plate 276, such advancement of drive nut 174 advances drive flange 272 and keeper plate 276 along rod 142, toward the rod's inward end. More particularly, such advancement of drive nut 174 drives each one of bars 294 through a corresponding one of stop flange 146's apertures 296 and into a corresponding one of adapter 110's apertures 126. The aforementioned engagement of key 182 within drive flange 272's keyway 283 (FIG. 11) and within rod 142's keyway 184 maintains alignment of drive flange 272 relative to stop flange 146 as bars 294 are driven into apertures 126.

FIGS. 4, 5A and 5B illustrate the extended position of studs 114 after insertion of adapter 110 into core 310 as explained above. As previously explained, each aperture 126 is located so that, when a corresponding row of studs 114 is extended from sleeve 112, the aperture 126 partially intersects the circumferential groove 115 of each stud in the row, without intersecting the bodies of any of the studs in the row. When the wedge-tipped inward end of a bar 294 reaches the groove 115 of the outwardmost one of studs 114 within one of apertures 126, the wedge tip slides easily over the groove's lower annular rim 117. As bar 294 is driven further into aperture 126, the wedge tip is forced against lower annular rim 117, driving stud 114 substantially perpendicularly toward adapter 110's longitudinal axis 120 and retracting stud 114's tip 116 from core 310. The tapered or conical shape of tip 116 facilitates such retraction.

Operation of the torque multiplier is continued to simultaneously drive each bar 294 completely into a corresponding one of apertures 126, until the inward face of drive flange 272 contacts the outward face of stop flange 146 (or spacer 144—if provided). The studs 114 in each row are thus successively retracted from core 310 (i.e. studs 114 are driven from the extended position shown in FIG. 4 into the retracted position shown in FIG. 3). This is shown in FIGS. 14 and 15B: the two outwardmost studs have been fully retracted from core 310 and the central stud has been partially retracted from core 310.

After all of adapter 110's studs 114 have been retracted from core 310 the torque multiplier is adjusted to reverse its drive direction, then actuated to rotate drive nut 174 so as to threadably retract drive nut 174 along rod 142 toward the rod's outward end, thereby retracting bars 294 from apertures 126 until the bars' wedge tips clear adapter 110's outward face 122. The inward end of tool 240, with reusable core adapter 110 captively mounted thereon, is then withdrawn from core 310. A wrench is then used to rotate lock arm shaft 150's squared outward end 186 counter-clockwise (as viewed from the left side of FIG. 14). Such rotation rotates locking pin arm 152 clockwise (as viewed in FIGS. 8 and 9), moving locking pin arm 152 and locking pins 156, 158 into the position shown in FIG. 8 in which locking pins 56, 58 are retracted within mandrel 148. Reusable core adapter 110 is then slidably removed from mandrel 148.

As previously explained, disposable adapter 10 is ultimately discarded with the spent roll core. It is accordingly desirable that adapter 10 be as inexpensive as possible. For example, the components in disposable adapter 10 can be less durable than the components in resusable adapter 110 to reduce costs, without compromising the ability to robustly couple adapter 10 to a roll core. The stud penetration depth of either adapter 10 or 110 into a roll core may be about 0.300 inches (about 7.6 mm).

As will be apparent to those skilled in the art in the light of the foregoing disclosure, many alterations and modifications are possible in the practice of this invention without departing from the spirit or scope thereof. For example, channels 168 and bars 194 may have mating cross-sectional shapes other than an inverted-T shape; retention of bars 194 within channels 168 can be achieved with any cross-sectional shape which is wider along a radially inward portion of each bar and channel and narrower along a radially outward portion of each bar and channel. Accordingly, the scope of the invention is to be construed in accordance with the substance defined by the following claims.

What is claimed is:

1. A core adapter, comprising:

(a) a hollow cylindrical sleeve having opposed outward and inward ends;

(b) a plurality of radial apertures formed in the sleeve, each radial aperture extending substantially perpendicular to a longitudinal axis of the sleeve;

(c) a sharp stud in each one of the radial apertures, each stud having:

(i) a tip recessed beneath an outer cylindrical surface of the sleeve;

(ii) a longitudinal axis substantially perpendicular to the longitudinal axis of the sleeve;

(d) the sleeve:

(I) having an outside diameter sized for insertion into a first roll core having a first inside diameter;

(ii) having an inside diameter substantially equal to a second inside diameter of a second roll core, the first inside diameter being larger than the second inside diameter, the inside diameter of the sleeve for receiving a core chuck; and (iii) being non-apertured between and through the outward and inward ends and between the outside and inside diameters in a direction substantially parallel to the longitudinal axis of the sleeve.

2. A core adapter as defined in claim 1, wherein the sleeve is flangeless and ribless.

3. A core adapter as defined in claim 2, wherein the studs are friction-fit embedded in the sleeve.

4. A core adapter as defined in claim 3, wherein the bottom of each one of the studs is rounded.

5. A core adapter as defined in claim 3, wherein each one of the studs has a tapered tip.

6. A core adapter as defined in claim 5, each stud having a bottom extending into a hollow core of the sleeve.

7. A core adapter as defined in claim 6, wherein the bottom of each one of the studs is rounded.

8. A core adapter as defined in claim 1, wherein the studs are spaced evenly in rows extending substantially parallel to the longitudinal axis of the sleeve.

9. A core adapter as defined in claim 8, wherein within each row, each stud is coplanar with one stud in each one of the other rows.

10. A core adapter as defined in claim 9, wherein the sleeve is formed of fiber core material.

11. A core adapter as defined in claim 9, wherein:

(a) the first diameter is nominally 6 inches;

(b) the second diameter is nominally 3 inches;

(c) the sleeve has a length of about 5 inches measured between opposed ends of the sleeve;

(d) the number of rows is 6; and (e) 5 radial apertures intersect each one of the rows.

12. A core adapter as defined in claim 11, wherein any one of the studs embedded adjacent one of the opposed ends of the sleeve is embedded about one inch away from that one end of the sleeve.

* * * * *